United States Patent [19]

Nowacki

[11] 4,261,254

[45] Apr. 14, 1981

[54] APPARATUS FOR FORMING WALL REINFORCEMENTS IN MULTIPLE INDIVIDUAL CARTONS

[75] Inventor: Ulrich G. Nowacki, Leisure City, Fla.

[73] Assignee: International Paper Company, New York, N.Y.

[21] Appl. No.: 20,860

[22] Filed: Mar. 15, 1979

[51] Int. Cl.[3] ..... B31B 7/60

[52] U.S. Cl. ..... 493/7; 493/12; 493/23; 493/167

[58] Field of Search ..... 93/36 R, 36 M, 49 R, 93/49 M, 49 AC, 51 R

[56] References Cited

U.S. PATENT DOCUMENTS

| | | | |
|---|---|---|---|
| 1,926,421 | 9/1933 | Andreas | 93/27 X |
| 2,371,046 | 3/1945 | Gregoire | 93/51 R |
| 2,620,711 | 12/1952 | Lindsay | 93/51 R |
| 2,957,395 | 10/1960 | Meyer | 93/49 R |
| 3,342,116 | 9/1967 | Roesner et al. | 93/49 M X |
| 4,022,116 | 5/1977 | Frappier | 93/49 M X |

*Primary Examiner*—Robert D. Baldwin
*Attorney, Agent, or Firm*—Paul C. Scifo

[57] ABSTRACT

Disclosed is an apparatus for forming wall reinforcements in multiple individual cartons. The apparatus includes a single entrance for admitting semi-finished cartons having vertically extending end wall flaps. The cartons are serially admitted centrally of the apparatus to a transport platform and distributed alternately to multiple wall reinforcements formers. The wall reinforcement formers are located in association with opposite ends of the platform and include work stations located along the platform. At the work stations, the vertically extending carton flaps are bent out of the vertical by flap preformers, as glue is applied in an automatically determined pattern to the wall to be reinforced. The glue pattern is determined by: the spacing of multiple interruptable light beams arranged transversely of the carton's paths, the glue applicator and the carton itself. Subsequently, flap folders, employing rigidly mounted rollers, drive the preformed flaps into the carton. Within the cartons, the wall reinforcements are formed as the rollers compress the flaps and glue patterned walls against anvils located in bracing relationship at the carton's exterior. Thereafter, reinforced cartons are ejected from the apparatus at multiple exits.

30 Claims, 13 Drawing Figures

APPARATUS FOR FORMING WALL REINFORCEMENTS IN MULTIPLE INDIVIDUAL CARTONS

This invention relates generally to apparatus for the construction of cartons. Particularly, the invention relates to apparatus for forming wall reinforcements in multiple individual cartons.

BACKGROUND OF THE INVENTION

In certain industries, it is commercially desirable to design shipping packaging to be reusable. For example, where the product for shipment and distribution is itself packaged in a form convenient for sale, it may be economical to reuse the shipping packaging once delivery is accomplished.

This concept applies in the beer brewing industry. Typically, beer which has been bottled can economically be shipped in cartons which may be emptied and reused. Moreover, if the beer bottles are themselves reusable, the reusable cartons become a convenient and economical means for storing and returning empty bottles for refilling.

For a shipping carton to be reusable, it must be durable. This is especially true where the items packaged are relatively heavy as in the case of beer bottles. Additionally, to be feasible for commercial use, the reusable carton must be low in cost. Typically, durability and cost considerations are in opposition and must be reconciled to obtain an optimum commercial design.

A factor intimately associated with carton cost and durability is the equipment used for its production. The production equipment must be capable of producing cartons at rates sufficiently high to keep cost per unit low. Further, the equipment must be capable of producing cartons, at the high production rates which are of acceptable quality. Yet further the equipment cost must be low enough to warrant investment by the user.

Therefore, the apparatus for producing a proposed design must itself meet certain criteria for the design to be acceptable. Specifically, the equipment must be capable of high production rates. Additionally, the equipment must be capable of producing products of acceptable quality at the high production rates. Finally, the equipment must be sufficiently low in cost to justify its use.

This invention relates to just such a situation. A carton design intended to be durable was proposed for use in the beer industry. A principal aspect of the proposed design was its strength. The strength resulted from the materials employed and the form of construction. More specifically, the general design called for a two element construction. One element of that construction was a reusable open topped shell. The shell was reusable by virtue of its strength. The principal reasons for the shell's strength was the use of compound end wall reinforcements.

The shell was to be formed as an open topped carton having side walls substantially perpendicular to the carton's width axis and end walls substantially perpendicular to the carton's length axis. The compound end wall reinforcement structures were to be finished by folding and gluing vertically extending end wall flaps into reinforcing relationship with the respective end walls.

Feasibility of the design was predicated upon the availability of equipment which could produce finished reinforced end walls of desired quality at high rate.

Rates of production required for economy, made it impossible to obtain finished cartons of acceptable quality with the use of a standard single carton flap folder. Simultaneous use of multiple individual folding equipment, while potentially meeting the speed requirements, rendered the equipment unacceptably high in cost. Multiple individual units in parallel also created questions of reduced system reliability due to increased numbers of components. Further, the use of multiple parallel arranged individual folding units required additional apparatus to join the parallel arranged single folders with the single output from the upstream equipment. Still further use of two parallel arranged single folders would require unnecessary duplication of many parts of the folding equipment itself.

Therefore, an object of this invention is to provide apparatus for forming carton wall reinforcements.

A further object of this invention is to provide apparatus for forming carton wall reinforcements at acceptably high production rates.

A further object of this invention is to provide apparatus for producing wall reinforcements of acceptable quality and integrity at high production rates.

A further object of this invention is to provide apparatus having a single input and multiple outputs.

A further object of this invention is to provide apparatus which avoids unnecessary duplication of equipment, while providing for multiple carton wall reinforcement formation.

A further object of this invention is to provide apparatus which is reduced in cost due to reduced numbers of components.

SUMMARY OF THE INVENTION

The present invention accomplishes the above objectives and others by including apparatus for forming wall reinforcements in multiple individual cartons.

Semifinished cartons having intergrally formed end wall flaps which extend substantially vertically above the carton top, are received through an entrance and gate located generally centrally of the apparatus. Cartons are sequentially admitted to a generally rectangular transfer platform having wall reinforcement formers located in association with each platform end. Cartons admitted are alternately shuttled over the transfer platform to one reinforcement former or the other by a distributor located in the platform. Each wall reinforcement former includes flap preformers for deflecting carton flaps out of the vertical, glue spraying apparatus for applying a predetermined pattern of glue at the interior of the carton end walls to be reinforced and flap folders for driving the flaps into the carton, where the flaps and end walls are compressed together. Following formation of the reinforcements, the flap folders are withdrawn and the finished cartons are alternately ejected at each flap folder by subsequent cartons.

The wall reinforcement formers include flap preformers for preforming the flaps in two steps as the glue is sprayed onto the interior of the wall to be reinforced.

The glue is applied automatically by a sprayer. The sprayer is activated when two transverse light beams spaced along the transfer platform's length axis are interrupted by the carton as it travels through the reinforcement former. The glue pattern applied is predetermined by the spacing of the light beams along the carton path, the focus of the glue sprayer and the dimensions of the carton itself.

The flap folders utilize rigidly mounted rollers driven in the vertical direction to fold the flaps into the carton and compress them with the respective end walls. The flaps and end walls are braced at the carton's exterior by fixed anvils. The fixed anvils are formed by lateral carton guides.

DESCRIPTION OF THE DRAWINGS

These and further features and advantages of the invention are apparent from a reading of the following detailed description with reference to the accompanying drawings wherein.

PREFERRED EMBODIMENT

FRAME

Figure 1:
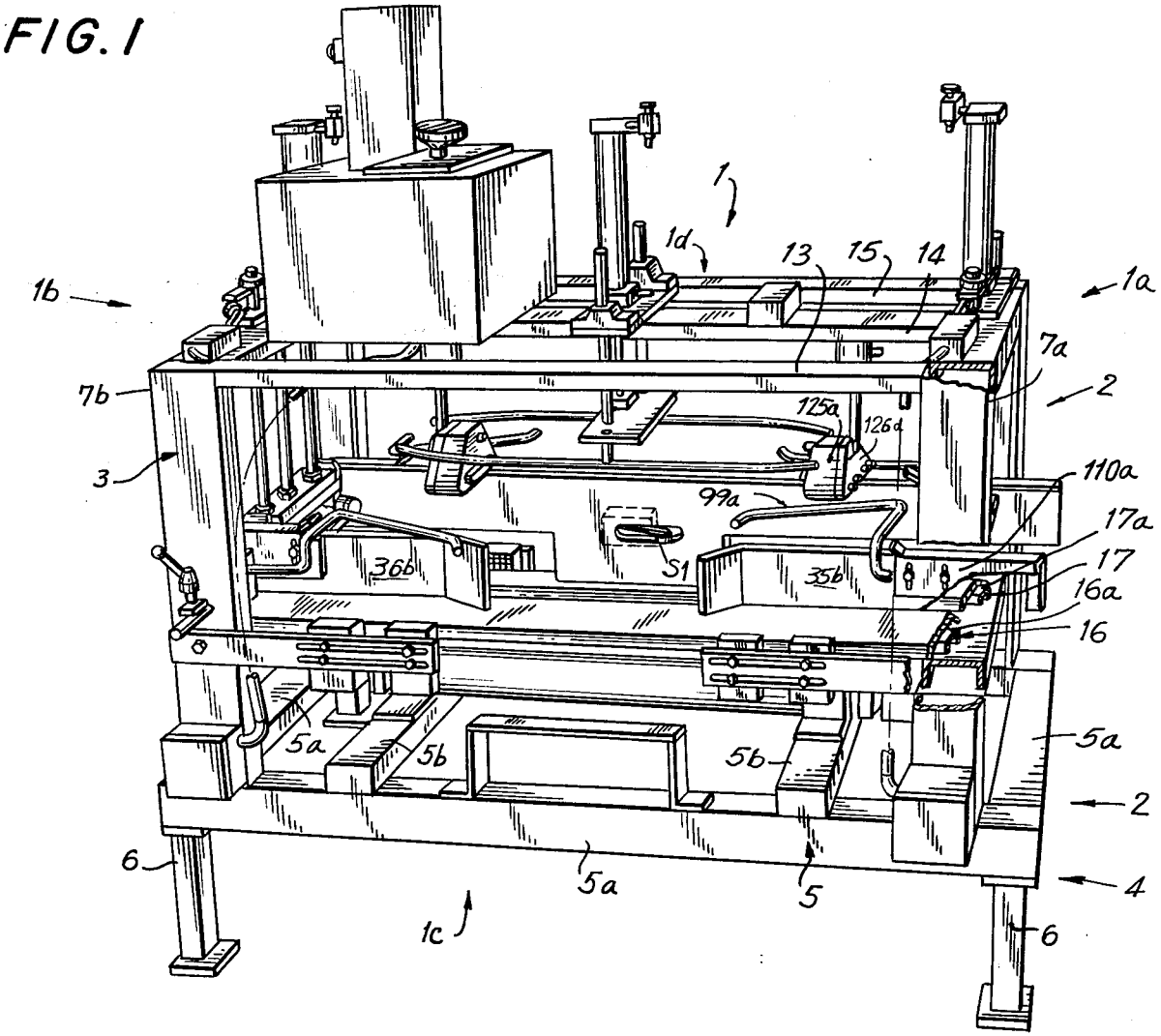
FIG. 1 is a fragmented perspective view of the apparatus of this invention.
Figure 2:
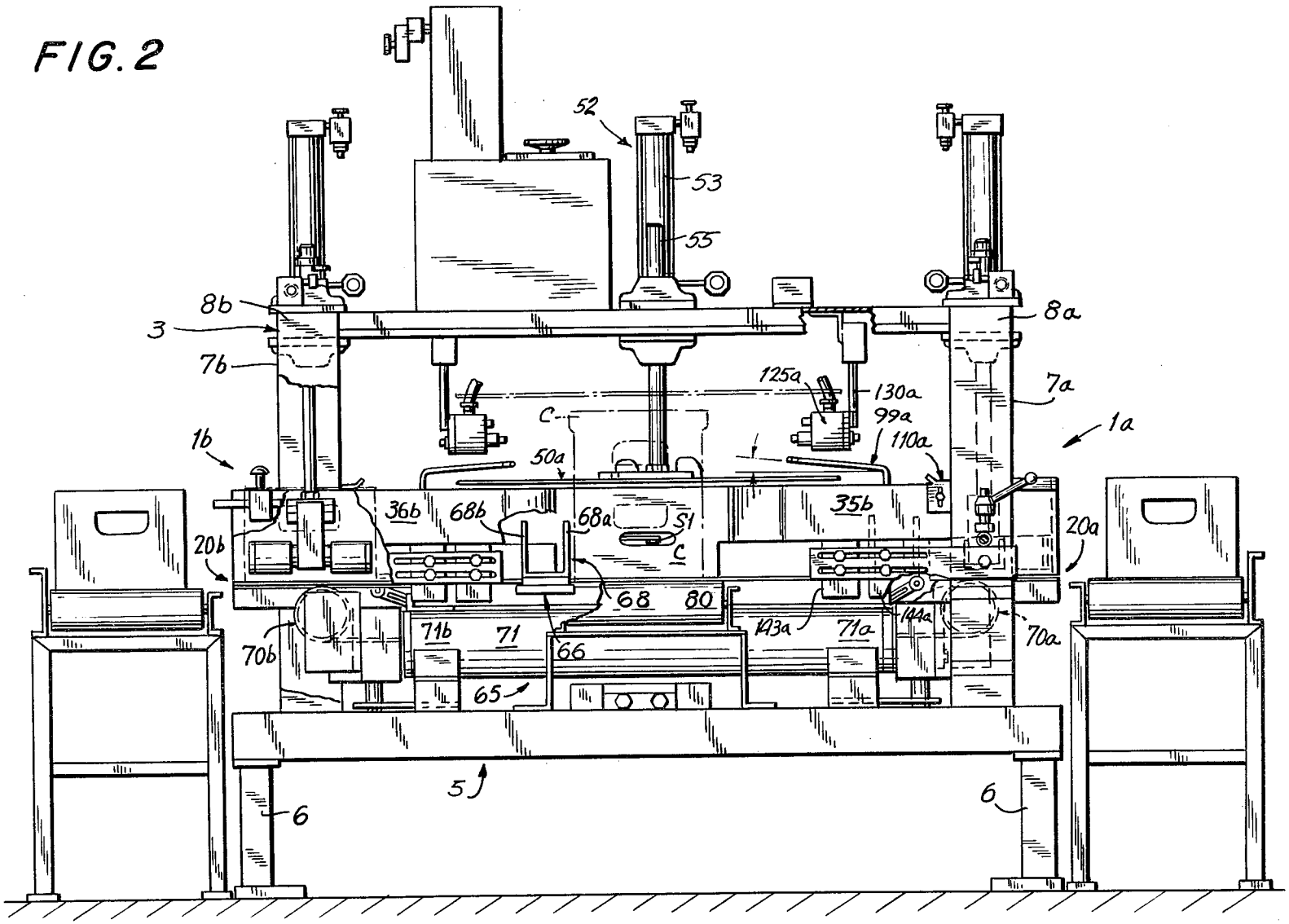
FIG. 2 is a front elevation view of the apparatus of this invention.
Figure 3:
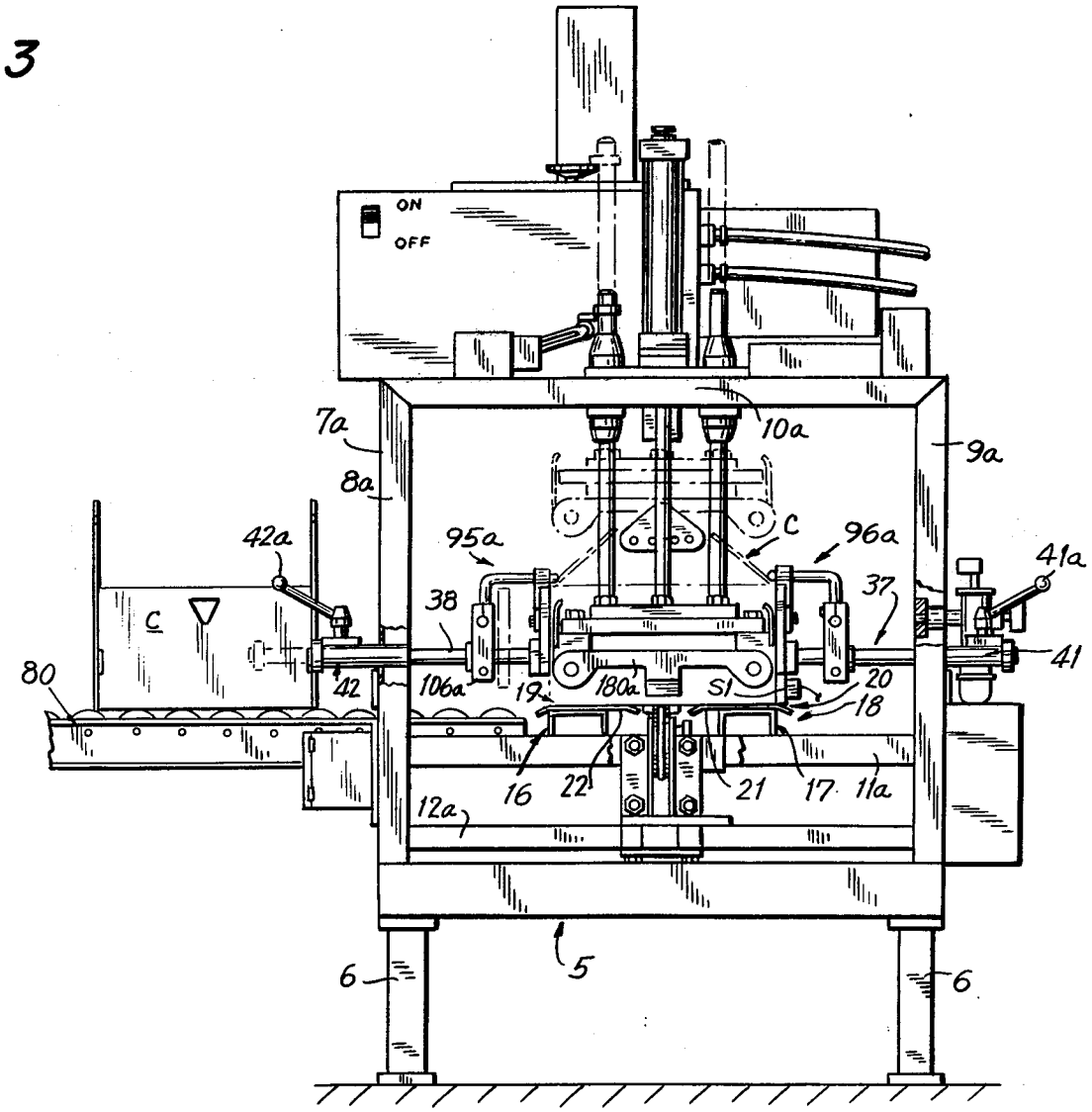
FIG. 3 is a side elevation view of the apparatus of this invention.

As seen in FIGS. 1, 2 and 3, the apparatus 1 can be described generally to have right and left sides 1*a* and 1*b*, front 1*c* and back 1*d*. The apparatus includes a frame 2, which has an upper frame section 3 mounted upon a lower frame section 4. Lower frame section 4 includes a rectangular base 5 defined by main beams 5*a* and cross beams 5*b*. Base 5 is supported on legs 6.

Upper frame section 3 is defined by two end stanchions 7*a* and 7*b* mounted upon base 5. End stanchions 7*a* and 7*b* are alike. For simplicity only end stanchion 7*a* will be described, it being understood that corresponding elements in stanchion 7*b* will bear appropriately similar designations.

As shown in FIG. 3, end stanchion 7*a* includes main vertical beams 8*a* and 9*a*, joined at their upper ends by top connecting beam 10*a*. Beams 8*a*, 9*a* are joined at their lower region by connecting struts 11*a* and 12*a*.

As seen in FIG. 1, stanchions 7*a* and 7*b* are joined at their upper ends by connecting struts 13, 14 and 15 and at their lower region by main beams 16 and 17. Beams 16 and 17 join stanchions 7*a* and 7*b* at connecting struts 11*a* and 11*b*, respectively.

The frame may be constructed of any suitable material and employ any convenient technique for forming joints and connections. In the preferred embodiment the frame is steel and joined at various points by welding and bolting.

BED

As seen in FIG. 3, a bed 18 is generally defined by beams 16 and 17 as supported on the frame structure described. The bed 18 has an upper surface 19 formed by upper surfaces 16*a* and 17*a* of beams 16 and 17, as best seen in FIG. 1. A planar, unobstructed transport platform 20 is formed at bed surface 19. In the preferred embodiment, platform 20 is formed by plates 21 and 22 affixed to the upper surfaces 16*a* and 17*a* of beams 16 and 17. Plates 21 and 22 are seen in detail in FIGS. 6, 7 and 8. The upper plate surfaces 21*d* and 22*d* are smooth and unobstructed to enable sliding thereon of carton C. The plates 21 and 22 are also provided with downwardly beveled regions 21*e*, 21*f*, and 22*e*, 22*f* to further avoid obstructions to movement.

Plates 21 and 22 may be of any suitable material and be affixed to beams 16 and 17 in any convenient manner, provided surfaces 21*d* and 22*d* which define platform 20 remain unobstructed to carton movement. In the preferred embodiment, platform 20 is formed by two stainless steel plates. However, it is to be understood that other constructions could be used, provided allowance is made for operation of the carton distributor to be more fully described hereinafter.

Figure 5:
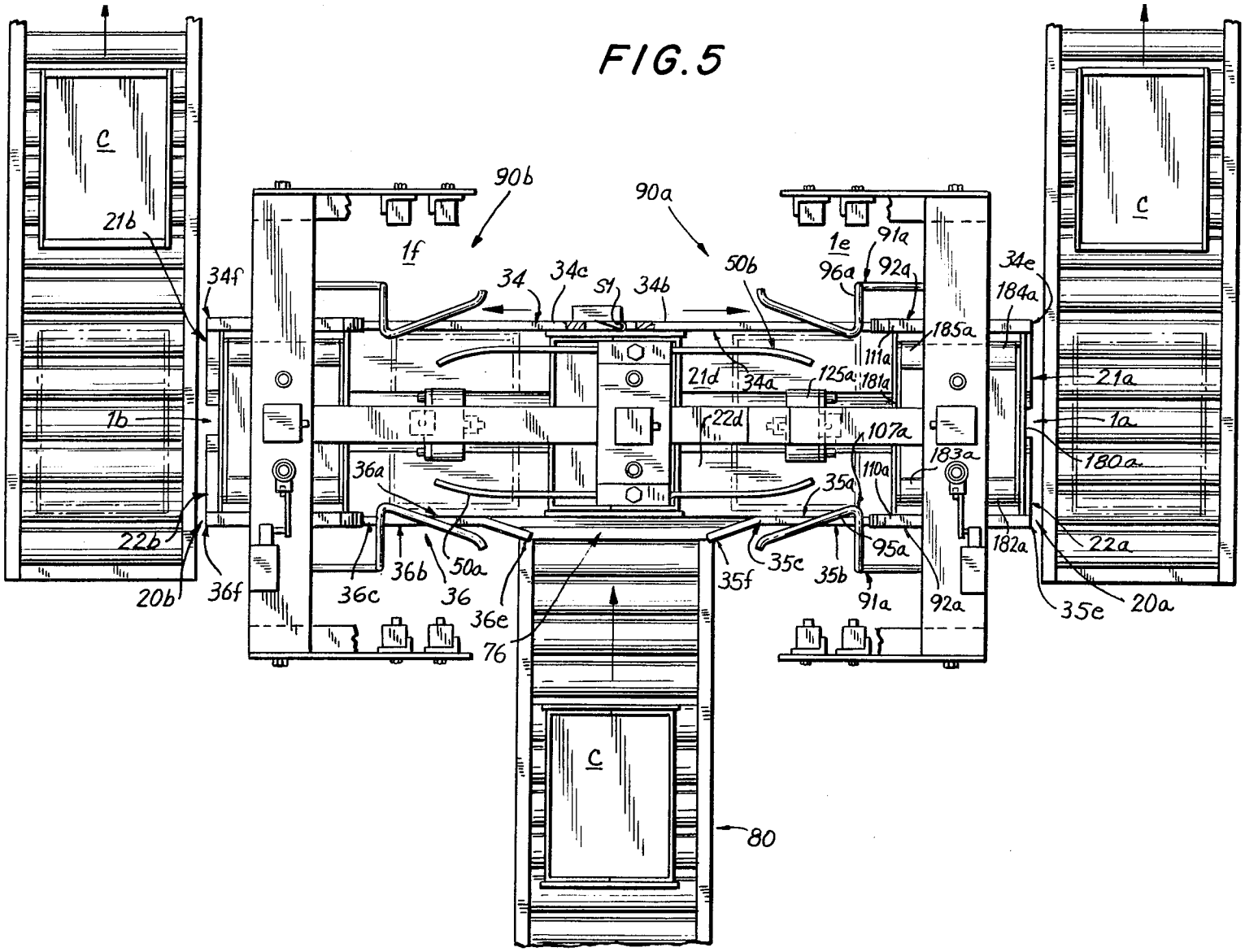
FIG. 5 is a schematic view of the apparatus of this invention showing the path of carton flow.

The platform 20 has a major axis in the direction of its length. Platform 20 extends in length from side 1*a* of the apparatus to side 1*b* of the apparatus. Further, platform 20 has a minor axis in the direction of its width. The minor axis is defined extending orthogonally to the major axis. As seen in FIG. 5, platform ends 20*a* and 20*b* are defined substantially perpendicular to the platform's length axis at ends 21*a*, 22*a*, and 21*b*, 22*b* of plates 21 and 22. The sides of platform 20 are defined as a family of planes substantially perpendicular to the platform's minor axis. It is to be noted, that the location of platform 20's sides will be defined by lateral guide rails 34, 35 and 36 to be described hereinafter.

DISTRIBUTOR

Figure 6:
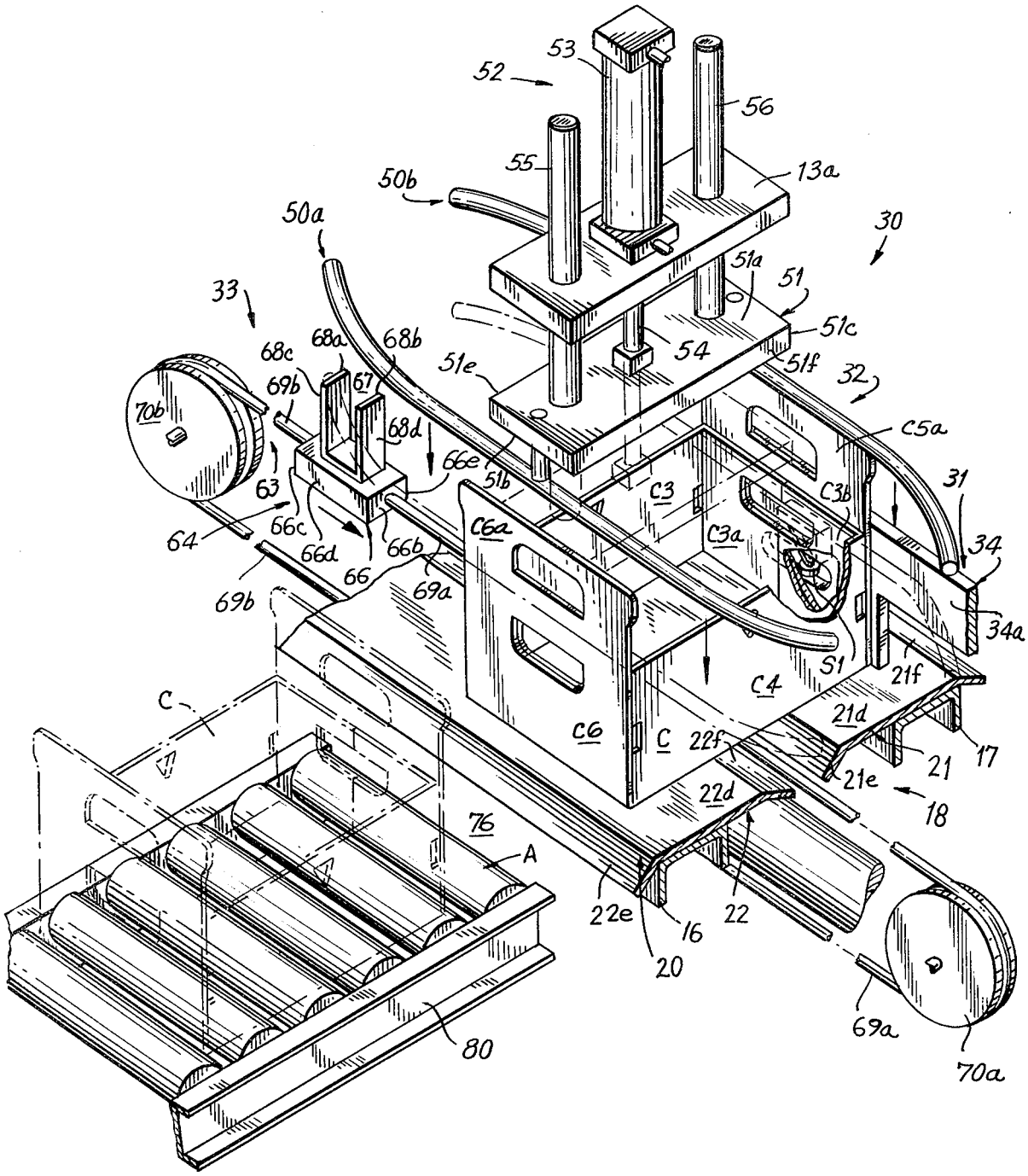
FIG. 6 is perspective view of the conveyer which feeds the apparatus of this invention and the receiver of this invention.

In FIG. 6, a distributor 30 is shown formed generally by lateral carton guides 31, a vertical carton guide 32, and a carton shuttle 33.

In the preferred embodiment lateral carton guides 31 are formed as rails 34, 35 and 36 shown in FIGS. 1 and 5. Rails 34, 35, and 36 have interior faces 34*a*, 35*a* and 36*a*, respectively and exterior faces 34*b*, 35*b*, and 36*b*. The rails have upper edges 34*c*, 35*c*, and 36*c*, and lower edges 34*d*, 35*d*, and 36*d*. The rails extend in platform 20's major axial direction between respective rail ends 34*e*, 34*f*, 35*e*, 35*f* and 36*e*, 36*f*. As shown, the rails are solid plate. However it will be appreciated that the rails may take other suitable forms.

Rails 34, 35, and 36 are mounted on the frame by support bars 37, 38, 39 and 40. Bars 37 and 40 support rail 34 and bars 38 and 39 support rails 35 and 36, respectively. Support bars 37, 38, 39 and 40 are connected with their length axis at right angles to the rails exterior faces 34*b*, 35*b*, and 36*b*, respectively.

Support bars 37, 38, 39 and 40 are slidably received in sleeves 41, 42, 43 and 44, respectively. Sleeves 41, 42, 43 and 44 are themselves fix mounted in vertical beams 9*a*, 8*a*, and 8*b*, 9*b* respectively. Movement of bars 37, 38, 39 and 40 in sleeves 41, 42, 43 and 44 may be prevented by any convenient means. In the preferred emodiment clamps 41*a*, 42*a*, 43*a* and 44*a* are used. Further, the bars may also be prevented from rotation by any standard means e.g., flats, keys, etc.

By this arrangement, rails 34, 35 and 36 may be adjustably located in planes perpendicular to platform 20 to define and locate the platform sides. The guide rails 34, 35, and 36 may be readily adjusted in platform 20's minor axis to accommodate cartons of varying dimensions.

As shown in FIG. 5, rail 34 extends laterally from end 34*e* at side 1*a* of the apparatus to end 34*f* at side 1*b* of the apparatus. Rail 35, on the other hand, extends laterally from end 35*e* at apparatus side 1*a* to end 35*f* located generally centrally of platform 20. Similarly, rail 36 extends laterally from end 36*f* at apparatus side 1*d* to end 36*e* generally centrally of platform 20. Rail ends 35*f* and 36*e* may be angled as shown in FIG. 5 to aid movement of a received carton.

Rods 37, 38, 39 and 40 are received through beams 9*a*, 8*a* and 8*b*, 9*b* at a vertical height such that rails 34, 35 and 36 are located with their upper rail edges 34*c*, 35*c* and 36*c* approximately at the top of the carton to be received, in order to aid stability of movement.

By the above arrangement, rail interior faces 34*a*, 35*a*, and 36*a* form lateral carton guides at the side of platform 20 along its major axis.

As shown in FIG. 6, a movable vertical carton guide 32 is formed by bars 50*a*, 50*b*, carriage 51, and actuator 52. Actuator 52 provides vertical movement of carriage 51 and bars 50*a*, 50*b*. Actuator 52 is mounted to the top of upper frame 3 at plate 13*a* in a standard manner. The actuator may be of any convenient type. In the preferred embodiment, the actuator is pneumatic.

Actuator 52 includes an actuator cylinder 53, an actuator piston 54 received in cylinder 53 and piston guide rails 55, 56. The piston 54 and guide rails 55 and 56 are connected at the upper surface of carriage 51. Carriage 51 is generally rectangular having an upper surface 51*a*, a lower surface 51*b*, ends 51*c*, 51*d*, and sides 51*e* and 51*f*. Bars 50*a*, 50*b* are removably mounted on carriage 51 at the ends 51*c*, 51*d*, respectively at lower surface 51*b*. Bars 50*a* and 50*b* are located in a common plane, generally parallel to each other, spaced in the minor axial direction of platform 20. The spacing between bars 50*a* and 50*b* is such they they fit between the vertical extending flaps of the semifinished carton C as shown.

By this arrangement, on activation of actuator 52, guide bars 50*a*, 50*b* may be vertically translated from a first vertical position above platform 20 to a second vertical position more proximate to platform 20. In the first position, guide bars 50*a* and 50*b* are out of the path of carton C shown received at platform 20 in FIG. 6. In the second position guide bars 50*a*, 50*b* are adjacent to the top of a carton C.

In the second position, bar 50*a*, in combination with carton C, will act to block admission of subsequent cartons. Actuator 52 is caused to operate lowering bars 50*a*, 50*b* from the first vertical position to the second vertical position when a carton C is first admitted from conveyer 80. This operation will be described more fully hereinafter with respect to the apparatus operation.

Apparatus distributor 30 also includes a shuttle 33. Shuttle 33 includes a carton engager 64 mechanically coupled to a cable and pulley system 63 which is activated by a diver 65. Shuttle 33 may be seen in FIGS. 2 and 6.

Referring to FIG. 6, carton engager 64 is formed as a generally rectangular block 66 having upper surface 66*a*, ends 66*b* and 66*c* and sides 66*d* and 66*e*. Attached to the block's upper surface 66*a* is a carton engager 67 in the form of a U-shaped pusher 68. Pusher 68 has engaging arms 68*a* and 68*b* with pusher faces 68*c* and 68*d*, respectively.

Cable segments 69*a* and 69*b* are connected at block ends 66*b* and 66*c*. The cable segments 69*a*, 69*b* are trained around pulleys 70*a* and 70*b*, respectively. The cable segments enter cable actuator 71 at actuator ends 71*a*, 71*b*, respectively. Actuator 71 is mounted to the frame as shown in FIG. 2. In the preferred embodiment, the actuator is pneumatic. Accordingly, cable segments 69*a*, 69*b* are mechanically coupled internally of pneumatic cylinder 71 to a piston. By this arrangement, cable 69*a*, 69*b* and block 66 may be reciprocated as the actuator piston is reciprocated in cylinder 71. The structure of pneumatic actuator 71 is well known and not part of this invention.

As seen in FIG. 6, shuttle 33 is located in bed 18 at platform 20, oriented for operation in platform 20's major axial direction. Cable segments 69*a* and 69*b* and block 66 are located in the minor axial direction of platform 20 between plates 21 and 22. Accordingly, as the pneumatic piston actuates cable segments 69*a* and 69*b*, block 66 is shuttled along the length of platform 20 in the space between plates 21 and 22. Further the location of block 66 explains the use of two plates 21, 22 to form platform 20. However it is to be recognized that other arrangement would be possible, as for example a slotted single plate.

Shuttle block 66 is placed between cable segments 69*a* and 69*b* such that it is skewed to one platform end or the other when at rest. From its rest position, block 66 will engage cartons admitted to platform 20, and alternately shuttle them towards end 1*a* or 1*b* of the apparatus. As in the case of vertical guide rail actuator 52, shuttle 33 is first activited when a carton enters platform 20. However shuttle 33's operation is delayed for a predetermined time to allow bars 50*a* and 50*b* to come into position. Further, shuttle 33 will be activated only if another carton can be received by the wall reinforcement formers as will be explained hereinafter.

RECEIVER

A receiver 75 is formed in the apparatus by an entrance 76 and gate 77.

The entrance 76 is formed generally centrally of the length of platform 20 by the space between lateral carton guide rail ends 35*f* and 36*e*. As seen in FIG. 6, a standard feed conveyer 80, not part of the present invention, may be orthogonally arranged with respect to platform 20's major axis. In this way, semifinished cartons from upstream equipment may be fed via conveyer 80 to platform 20 of the present apparatus at entrance 76.

As stated above, in the second position, bars 50*a* and 50*b* restrain vertical carton movement. Additionally, in the second position bar 50*a* can restrain a carton at conveyer 80 from gaining admittance to platform 20 through entrance 76. Further, where a carton is already present on platform 20 at entrance 76, admission of additional cartons will be prevented until the received carton is shuttled by block 66. Accordingly, by such action, a gate 77 is established at entrance 76. This action will be further described in associations with apparatus operation hereinafter.

WALL REINFORCEMENT FORMERS

Two wall reinforcement formers 90*a* and 90*b* are provided in the apparatus. The reinforcement formers 90*a* and 90*b* are alike and located in association with opposite ends 1*a* and 1*b*, respectively of the apparatus. As such, the apparatus is subdivided generally into two wings 1*e* and 1*f* arranged on opposite sides of entrance 76. This subdivision may best be seen in FIG. 5.

Since wall reinforcement formers 90*a* and 90*b* are alike, for simplicity only former 90*a* will be discussed. It is to be understood that the elements of 90*b* correspond to the elements of 90*a* to be described.

Wall reinforcement former 90*a* includes a plurality of work stations located along platform 20 and in association with frame 2. Wall reinforcement former 90*a* includes two sets of vertical flap preformers 91*a* and 92*a*, a glue applicator 93*a* and a vertical flap folder 94*a*.

Before discussing the detailed nature of the work stations which constitute the wall reinforcement former 90*a*, it will be of value to describe the design of carton C and its state of completion upon admission to the apparatus.

Figure 4:
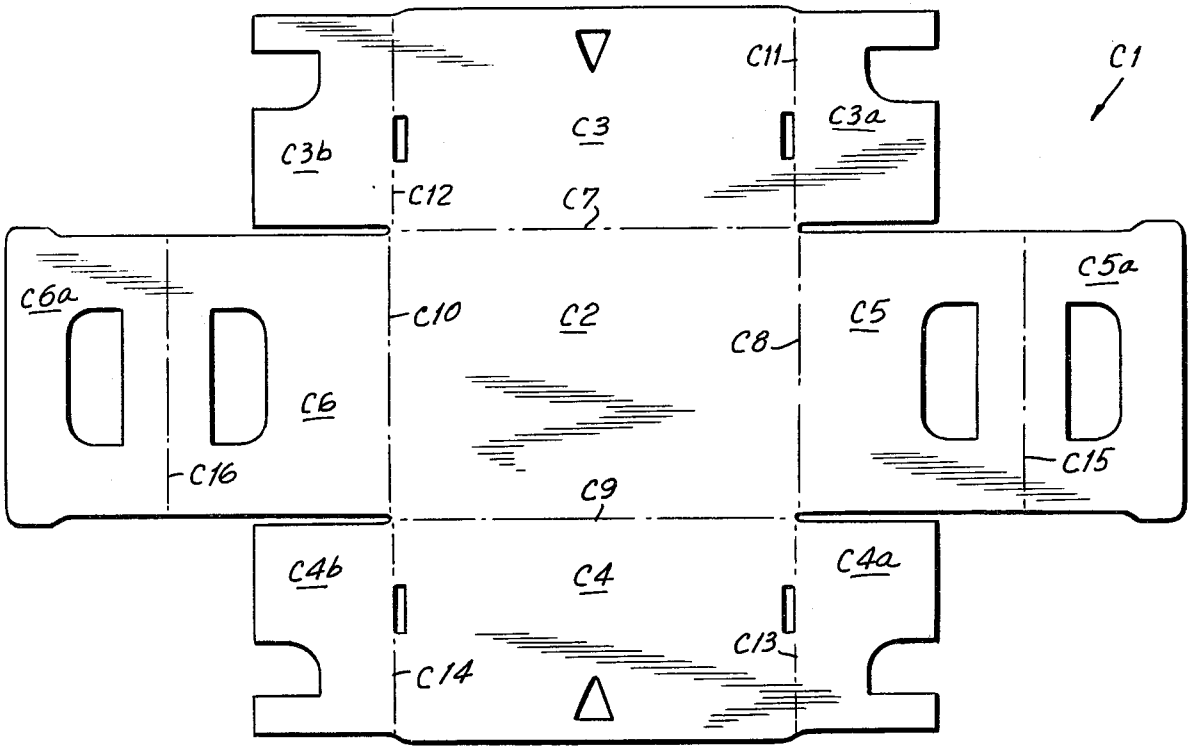
FIG. 4 is a plane view of the carton blank prior to formation into the semifinished carton.

As shown in FIG. 4 the carton C is originally in the form of a blank C1. The blank will ultimately be made into the desired carton. With reference to blank C1, the carton C is seen to have a bottom C2, side wall C3 and C4 with corresponding side wall flaps, C3*a*, C3*b*, C4*a* and C4*b*, end walls C5 and C6 with corresponding end wall flaps C5*a* and C6*a*. Carton C is formed by folding the various elements with respect to one another. The particular sequence to be described is merely illustrated and is not meant to describe the preferred method of making the carton from the blank.

The carton may be formed by folding side wall end flaps C3*a*, C3*b*, C4*a* and C4*b* along fold lines C11, C12, C13 and C14, respectively from the plane of the blank to the vertical. Subsequently sides 3 and 4 may be folded out of the plane of the blank into the vertical along fold lines C7 and C9. Thereafter end walls C5 and C6 may be folded out of the plane of the blank into the vertical along fold lines C8 and C10, respectively. Flaps C3*b* and C4*b* may next be joined (as by gluing) to end walls C5 and flaps C3*a* and C4*a* joined to end wall C6. The resulting structure is the semifinished carton received by the apparatus of this invention. As is clear from FIG. 6, at this stage of construction, flaps C5*a* and C6*a* extend vertically above the carton top in a plane parallel to the plane of the end walls C5 and C6, respectively.

The function of each wall reinforcement former 90*a*, 90*b* is to: (a) deflect flaps C5*a* and C6*a* out of the vertical by preforming or prefolding flaps C5*a* and C6*a* along lines C15 and C16, (b) apply glue in a predetermined pattern to the interior of the carton at folded flaps C3*b*, C4*b*, C3*a* and C4*a* and (c) drive preformed flaps C5*a* and C6*a* into the carton against flaps C3*b*, C4*b* and C3*a*, C4*a*, to establish the finished reinforced walls C5 and C6, respectively.

As seen in FIG. 5 the apparatus of the preferred embodiment uses two sets of vertical flap preformers 91*a* and 92*a*.

The first set of preformers 91*a*, include preforming bars 95*a* and 96*a* which are mirror images of one another. Bars 95*a* and 96*a* are mounted on opposite sides of platform 20. Bar 95*a* is continuous, but subdivided into three regions. Bar 95*a* is subdivided into a region 97*a* for mounting the bar on the apparatus, a region 98*a* for locating the bar with respect to platform 20 and a region 99*a* for accomplishing the desired flap preforming.

Figure 7:
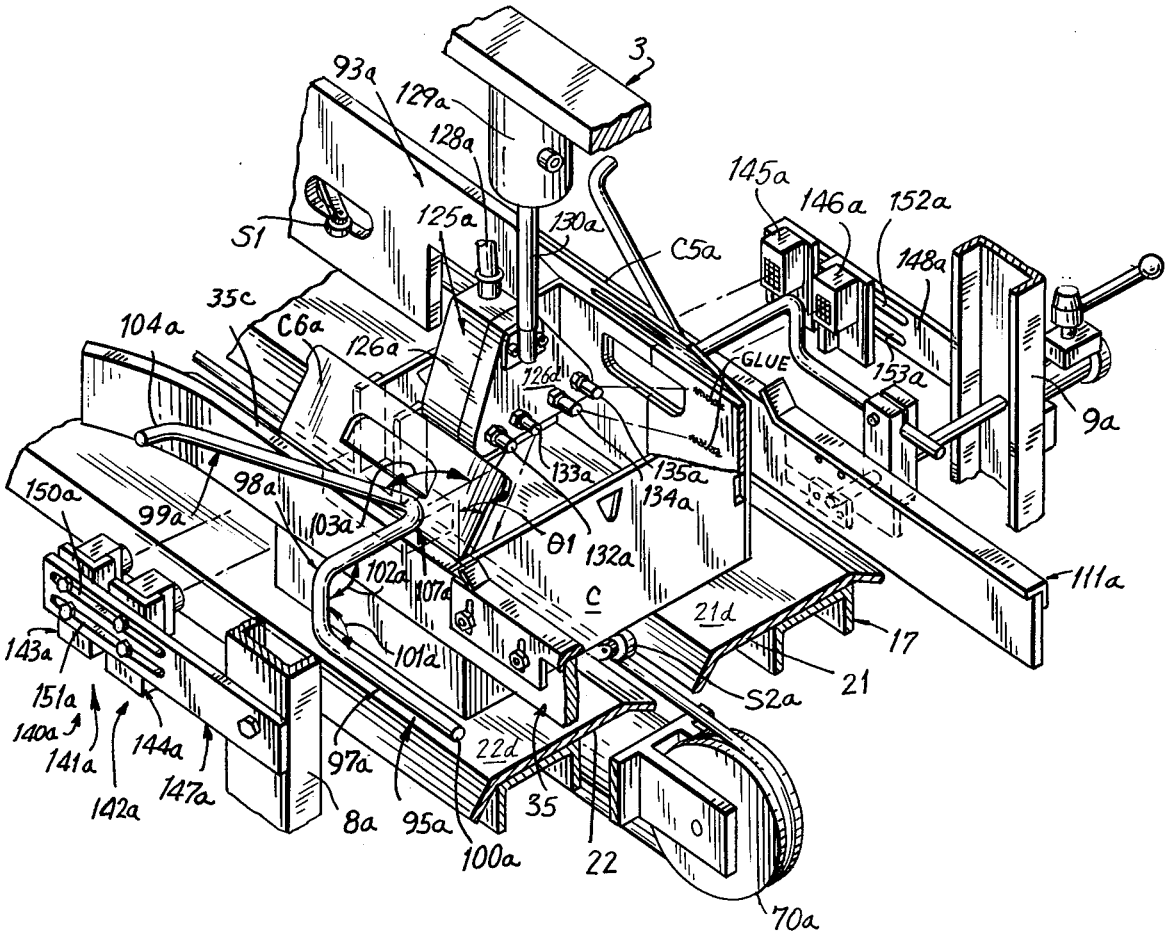
FIG. 7 is a perspective view of the flap preformers and glue applicator of the wall reinforcement former of the invention.

As seen in FIG. 7, beginning at a first end 100*a*, bar 95*a* extends in straight line fashion over region 97*a* to a first right angle bend 101*a*. Bend 101*a* forms the transition from regions 97*a* to 98*a*. Region 98*a*, continues from angle 101*a* for a length to another right angle bend 102*a*. At angle 102*a*, region 98*a* continues for a length to an obtuse angle bend 103*a* denoting the beginning of region 99*a*. Region 99*a* continues at obtuse angle 103*a* to its end 104*a* which is further bent at angle 105*a*. Further in the preferred embodiment region 99*a* as shown in FIG. 2 rises at a shallow angle of approximately 5 degrees as it extends from bend 103*a*.

Bar 96*a* is similar to bar 95*a*, however as noted above bar 96*a* is the mirror image of bar 95*a*.

As seen in FIG. 3, bar 95*a* is adjustably mounted to lateral carton guide support bar 38 by orthogonal connecting block 106*a*. Bar 95*a* is mounted orthogonally of bar 38 by block 106*a* at region 97*a*. As seen in FIG. 7, bar 95*a* extends horizontally in a plane above and outboard of platform 20, proximate to guide rail 35 in a direction substantially parallel to the platform's major axis. At region 98*a*, bar 95*a* rises vertically to a point above the upper rail edge 35*c*. At right angle 102*a*, bar 95*a* is seen to proceed horizontally inboard of guide rail 35 and platform 20 to a point 107*a* above platform 20, best seen in FIG. 5. At point 107*a*, bar 95*a* bends at obtuse angle 103*a* and continues outboard of guide rail 35 and platform 20 as it rises to its end 104*a*. In this orientation, bar 95*a* is inboard of rail 35 and platform 20 at point 107*a* and outboard of rail 35 and platform 20 at its end 104*a*. Thus, 95*a* is inboard nearest platform end 20*a* and outboard further from the platform end 20*a*.

Bar 96*a* while mounted similarly to bar 95*a*, is mounted as the mirror image of bar 95*a*. Accordingly, a funnel like structure as best seen in FIG. 5 is established by bars 95*a* and 96*a*. The funnel structure being necked down as platform end 20*a* is approached from entrance 76.

As a carton is shuttled through reinforcement former 90*a*, the vertically extending carton flaps C6*a* and C5*a* engage region 99*a* of bar 95*a* and the corresponding region of bar 96*a*. As C6*a* and C5*a* engage 95*a* and 96*a* the vertically extending flaps are deflected inboard of the carton and out of the vertical plane of the respective carton end walls to a first preform angle $\theta 1$ seen in FIG. 7. This angle is less than 90 degress and preferably about 45 degrees.

The angle $\theta 1$ is adjusted by varying point 107*a*. The further inboard of rail 35 and platform 20 point 107*a* is located, the greater the angle $\theta 1$ will be. Point 107*a* can be readily adjusted by sliding block 106*a* along bar 38 either to or away from rail 35 as seen in FIG. 3.

Figure 8:
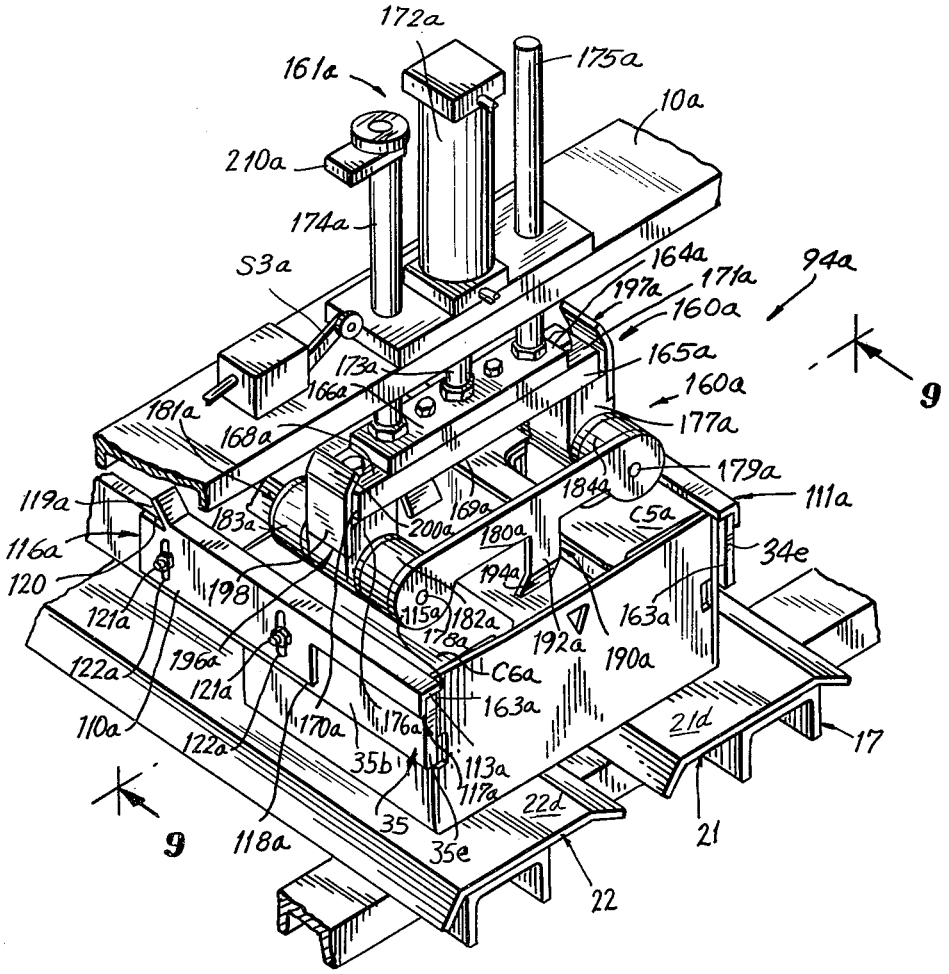
FIG. 8 is a perspective view of the flap folder of the wall reinforcement former of this invention.
Figure 9:
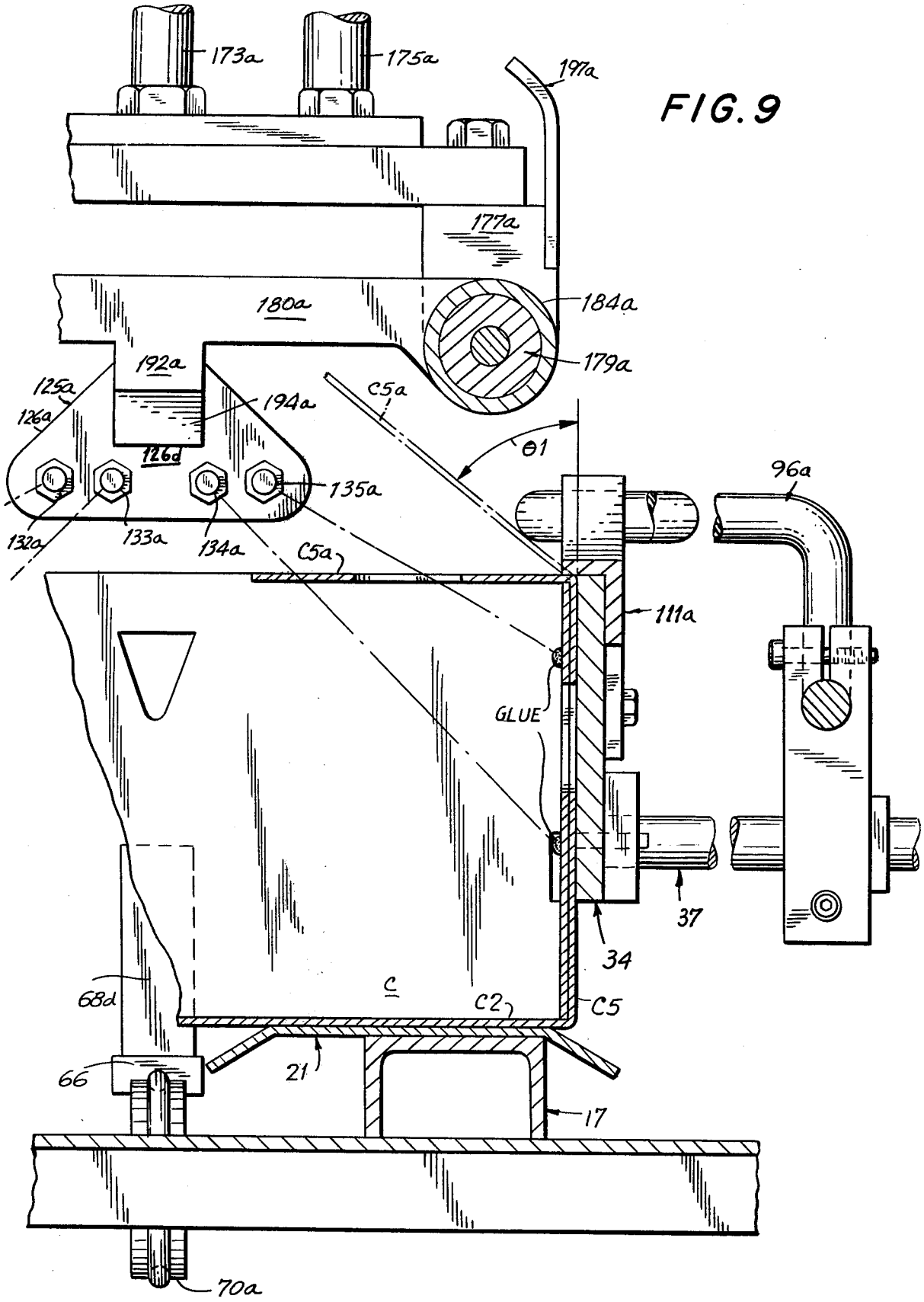
FIG. 9 is a fragmented sectional view of the flap folder in the up position taken at line 9—9 of FIG. 8.
Figure 10:
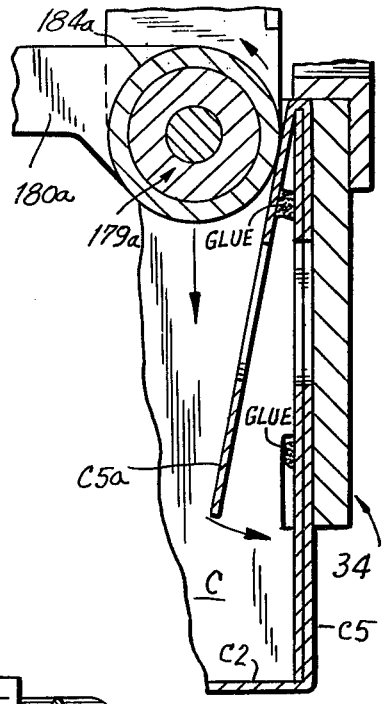
FIG. 10 is a fragmented cross-sectional view of the flap folder in a lowered position, as the rollers enter the carton taken at line 9—9 of FIG. 8.
Figure 11:
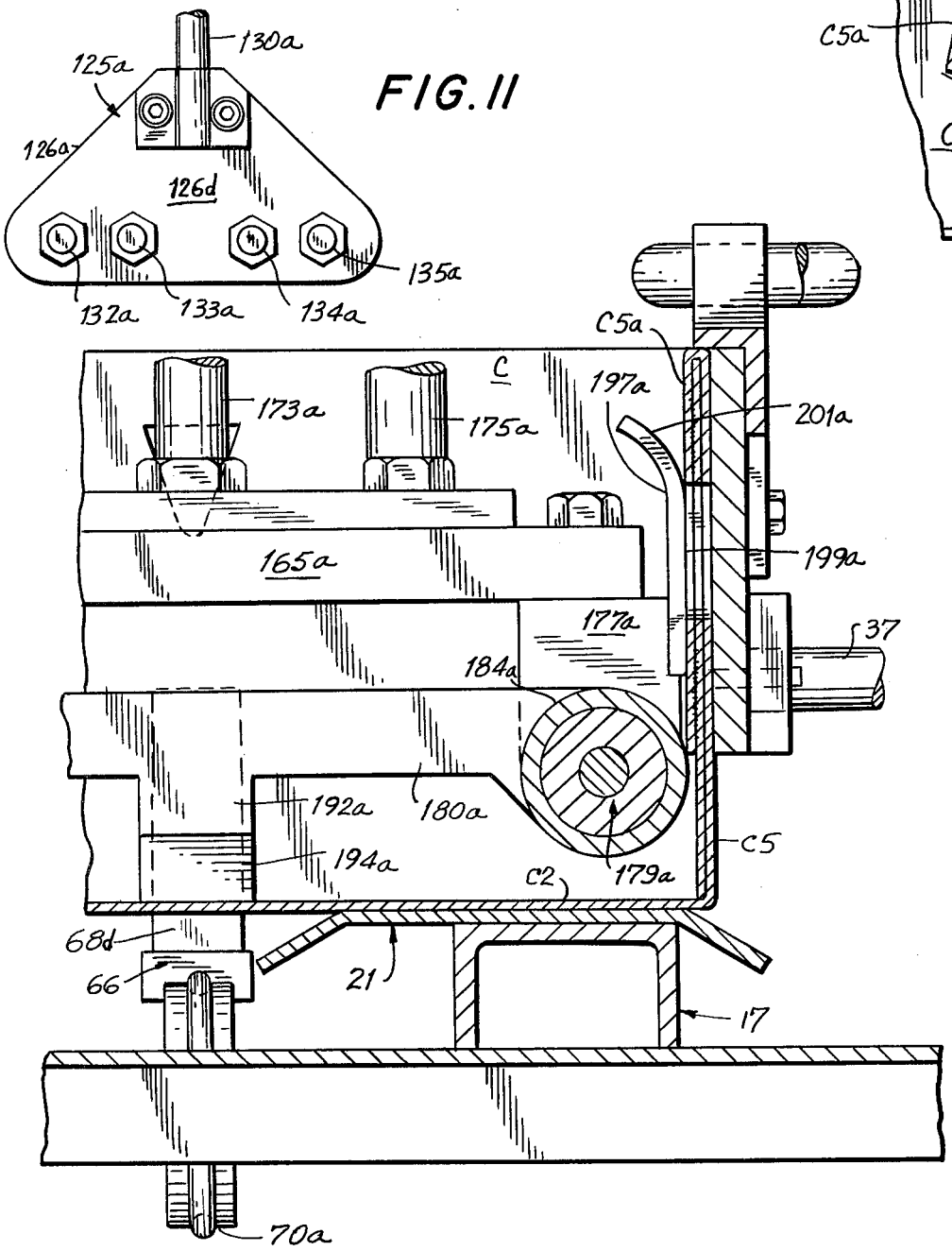
FIG. 11 is a fragmented cross-sectional view of the flap folder in its lowermost vertical position taken along line 9—9 of FIG. 8.

The second set of preformers 92*a* is seen in FIGS. 1 and 8 to be a pair of generally rectangular plates 110*a* and 111*a*. The plates are similar. However, as in the case of bars 95*a* and 96*a* the plates are mirror images of one another. Plate 110*a* is seen to have upper edge 113*a* bent at right angles to the plane of the plate body, forming therewith a lip 115*a*. Plate 110*a* also has a leading edge 116*a* and a trailing edge 117*a* and a lower edge 118*a*. At upper lip 115*a*, in the region of the leading edge 116*a*, a finger 119*a* is formed by inclining lip 115*a* at an acute angle 120*a* to edge 113*a*. Preferably, the angle is approximately 30 degrees.

The Plates 110*a* and 111*a* are mounted on the exterior face 35*b* and 34*b* respectively of the lateral carton guide rails 35 and 34. The plates are adjustly mounted in any convenient manner, as for example with bolts 121*a* in slot 122*a*. Further, Plates 110*a*, 111*a*, are mounted with respective lips, i.e. 115*a* extending above the upper guide rail edges 35*c* and 34*c*. Leading edges, i.e. 119*a* are oriented furthest from platform end 20*a*. The plates are mounted on guide rails 35 and 34 beginning, at ends 35*e* and 34*e* thereof and extend towards the center of platform 20.

In FIG. 7, the glue applicator 93*a* of the present invention is seen to include a glue sprayer 125*a* having a head 126*a*, plurality of spray nozzles 132*a* to 135*a* and a glue supply conduit 128*a*. The glue sprayer 125*a* is standard and generally available, as such its particular structure is not part of this invention.

The sprayer head 126*a* is vertically suspended from upper frame 3 above and centrally of the width of platform 20 by clamp 129*a* and arm 130*a*. The glue sprayer is further located between the two sets of flap preformers 91*a* and 92*a* in platforms 20's major axial direction. The glue head 126*a* is seen in FIG. 7 to be generally formed as a triangular block having rear face 126*d*. Four glue spray nozzles 132*a* to 135*a* are located at the rear face of the head 126*a*, distributed in the region of the head's base. The four nozzles 132*a* to 136*a* are arranged so that two nozzles 132*a* and 133*a* can be focused to one side of platform 20 and two nozzles focused to the other side of platform 20 as shown. It is further contemplated that nozzles 132*a*, 134*a* and 133*a*, 135*a* would be focused at different heights above platform 20 on the plane of carton walls C6*a* and C5*a*, respectively. Further, the nozzles are designed to provide a focused spray. Glue is supplied to the sprayer head 126*a* by conduit 128*a*.

The glue applicator 93*a* of the present invention is supplied with a controller 140*a* for activating the glue sprayer 125*a* in response to movement of the carton C along platform 20.

In the preferred embodiment the control means includes two electric eyes 141*a* and 142*a* which establish light beams transverse of platform 20 major axis i.e. in the minor axial direction of platform 20. The control means also includes an electrical circuit, responsive to electric eyes 141*a*, 142*a* to supply a signal to the sprayer 125*a* only when both beams are interrupted. The circuit is standard and need not be described.

Each electric eye 141*a* and 142*a* includes a light source 143*a* and 144*a* and a light sensor 145*a* and 146*a*, respectively. Light sources 143*a*, 144*a* are located on one side of platform 20 or the others with light sensors 145*a* and 146*a*, respectively on the corresponding opposite sides as shown in FIG. 7. Mounting plates 147*a* and 148*a* are provided extending in a plane parallel to the sides of platform 20 at right angles to the vertical support beams 8*a* and 9*a*. The mounting plates are provided with two adjustment slots 150*a*, 151*a*, and 152*a*, 153*a* respectively so that the spacing between light sources 143*a*, 144*a* and corresponding light sensors 145*a*, 146*a* in platform 20's major axial direction may be adjusted.

Mounting plates 147*a* and 148*a* are vertically located along main beams 8*a* and 9*a* so that the light sources 143*a*, 144*a* and sensors 145*a*, 146*a* may establish light beams transverse of platform 20 in the region of platform 20's surface. Plates 147*a* and 148*a* extend horizontally toward the center of platform 20, in a direction parallel to its major axis. The light sources 143*a*, 144*a* and sensors 145*a*, 146*a* are arranged along the axial length of platform 20 at a point in proximity to the glue applicator 93*a*, and in particular spray nozzles 132*a* to 135*a*.

In the preferred embodiment, the light sources 143*a*, 144*a* and light sensors 145*a*, 146 are symmetrically disposed in the major axial direction of platform 20 on either side of nozzles 132*a* to 135*a*.

With this arrangement, as the carton's vertical flap are preformed, glue may be sprayed at the interior end walls of the carton, as seen in FIG. 7.

With reference to FIG. 8, the vertical flap folder 94*a* of the present invention is seen to include an actuator 161*a*, a carriage 160*a*, rollers 182*a* to 185*a* mounted to the carriage and anvils 163*a* defined by guide rails 34 and 35 located at the platform sides.

The actuator 161*a* is mounted on and through connecting beam 10*a* of upper frame 3 at end stanchion 7*a*. Actuator 161*a* is mounted in the standard manner and need not be described further. Actuator 161*a* is seen to have an actuating cylinder 172*a*, a piston 173*a* received in the cylinder 172*a* and guide rods 174*a*, 175*a*. The actuator 161*a* in the preferred embodiment is pneumatic.

The carriage 160*a* is seen to have an upper yoke 164*a* and a lower support bar 165*a*. Yoke 164*a* has an upper surface 166*a*. Lower support bar 165*a* has an upper surface 168*a*, lower surface 169*a* and ends 170*a*, 171*a*, respectively. As shown, yoke 164*a* is removably connected to bar 165*a*. The ends 170*a*, 171*a* of bar 165*a* define the ends of carriage 160*a*.

The actuator piston 173*a* with guide rods 174*a*, 175*a* are connected to upper surface 166*a* of yoke 164*a* so carriage 160*a* may be translated in the vertical direction when the actuator 161*a* is activated.

Carriage 160*a* mounts rollers 182*a* to 185*a* with support blocks 176*a*, 177*a*, shaft and bushing assemblies 178*a*, 179*a*, side support plates 180*a*, 181*a* and rollers 182*a*, 183*a*, 184*a* and 185*a*. Rollers 182*a* to 185*a* are rigidly and rotatably mounted in a conventional manner by assemblies 178*a* and 179*a*. Assemblies 178*a* and 179*a* are received in blocks 176*a* and 177*a*. Blocks 176*a* and 177*a* are mounted at the ends 170*a*, 171*a* of bar 165*a*. Any convenient mounting method may be used as, for example, by bolting. Assemblies 178*a* and 179*a* are held at about their midpoints by blocks 176*a*, 177*a*. As a result, rollers 182*a* to 185*a* are disposed on either side of blocks 176*a*, 177*a* at both ends 170*a*, 171*a* of bar 165*a*, respectively.

Side support plates 180*a*, 181*a* are provided to join assemblies 178*a* and 179*a*. Plates 180*a*, 181*a* define the sides of carriage 160*a*. Carton positions skids 190*a*, 191*a* are located centrally of plates 180*a*, 181*a* in the form of rectangular plates. The skids 190*a*, 191*a* extend downwardly in a plane parallel to the sides of the carriage 160*a* as above defined for a predetermined distance over regions 192*a*, 193*a*, respectively. Thereafter, the skids extend at acute angles to the plane of the carriage sides, inboard thereof, for a further distance over regions 194*a*, 195*a* to their respective ends.

Further, removal skids 196*a*, 197*a* are provided at the ends 170*a*, 171*a* of bar 165*a* in planes parallel to the ends of the carriage as above defined over regions 198*a*, 199*a*. Thereafter the skids 196*a*, 197*a* bend inboard of the carriage at an acute angle over regions 200*a* and 201*a*, respectively.

OPERATION

A comprehensive view of carton flow through the apparatus is seen in FIG. 5. Cartons are fed to the apparatus by conveyor 80. As fed, the cartons are oriented with their length axis in the direction of travel. As a result, the cartons are fed "end first". Cartons are admitted to the apparatus at platform 20, through entrance 76. On being received at platform 20, cartons are alternately distributed right and left to apparatus wing 1*e* and 1*f*, by shuttle 33. As cartons are alternately shuttled right and left along platform 20, they are caused to be moved through either wall reinforcement former 90*a* or 90*b*. Following formation of wall reinforcements finished cartons are ejected through exits formed by the open platform ends 20*a* and 20*b*. On exit at apparatus sides 1*a* and 1*b*, respectively, cartons are taken away by conveyers 220*a* or 220*b*.

The particular events of the above-noted sequence may be understood in greater detail with reference to FIGS. 6 to 11.

The admission of carton C to platform 20 is shown in FIG. 6. When carton C is in position A, shown in phantom on conveyer 80, carton sensor S1 indicates to the apparatus no carton has yet been admitted. Therefore, vertical guide bars 50*a*, 50*b* remain in the up position. Further, shuttle block 66 is at rest skewed to one side of platform 20 or the other. As shown, shuttle block 66 is skewed left, ready to shuttle right toward platform end 20*a*.

Under these conditions, carton C is free to be admitted to platform 20, i.e. plates 21, 22, through entrance 76. On entry, the leading carton end wall actuates sensor S1. In response, sensor S1 advises the apparatus of carton C's entry. Command is then sent to activate actuator 52. In response, actuator 52 lowers guide bars 50*a* and 50*b* from their first vertical position to the second vertical position adjacent to the carton top between vertical flap ends C5*a* and C6*a* as shown.

On notice of admission of carton C, shuttle 33 is activated in a timed delayed manner to cause shuttle block 66 to shuttle right engaging the carton side wall after bars 50*a* and 50*b* have to come into position adjacent the top of carton C. Thereafter block 66 continues to shuttle carton C along platform 20, as defined by plates 21 and 22, toward wall reinforcement former 90*a*.

As carton C is shuttled to the right along platform 20, it leaves the region of sensor S1. Accordingly, sensor S1 advises the apparatus that a subsequent carton may be admitted. In response, actuator 52 is activated to raise bars 50*a* and 50*b* to their first vertical position for admission of a subsequent carton.

Prior to the carton leaving the region of sensor S1, the carton end wall and bar 50*a* act as a closed gate preventing admission of further cartons to platform 20.

In the present embodiment, sensor S1 is a pressure sensitive electrical switch, located in lateral guide rail 34. The switch is activated by the carton's leading edge on its admission to platform 20, It is to be appreciated that other types of sensors could be utilized to the same effect.

It is to be noted that the following features of this invention contribute individually and collectively to the ability of the apparatus to alternately distribute multiple cartons, received at a single entrance, to multiple wall reinforcement: location of shuttle 33 for reciprocal action in the major axis of platform 20, locaton of wall reinforcement formers 90*a* and 90*b* at opposite platform ends 20*a*, 20*b* and the initial skewing of shuttle block 66 to one side of the apparatus.

As carton C leaves the region of sensor S1, it continues to be shuttled by block 66 to the right toward the work zone of wall reinforcement former 90*a*. As carton C is shuttled along platform 20's major axial direction, it is restrained from lateral movement by guide rail interior surfaces 34*a* and 35*a* previously described.

The details of carton C's movement through wall reinforcement former 90*a* may best be seen in FIGS. 5, 7 and 8. With reference to FIG. 7, as carton C leaves the region of sensor S1, and while vertical guide bars 50*a* and 50*b* are still in place, carton C is moved into the first set of flap preformers 91*a*. As such, vertical restraint is assumed by preformers 91*a* from bars 50*a* and 50*b* as the carton C enters reinforcement former 90*a*.

As seen in FIG. 5, the carton vertical end wall flaps, C6*a* and C5*a*, first engage bars 95*a* and 96*a*, respectively where each bar crosses lateral guide rails 35 and 36. As the carton C is shuttled into the first preformer, flaps C6*a* and C5*a* are deflected out of the vertical to a first preform angle $\theta 1$. In the preferred embodiment, the first preform angle $\theta 1$ is approximately 45 degrees and may best be seen in FIG. 9. It may also be seen in FIG. 9 that as first preformer bars 95*a* and 96*a* are moved inboard of lateral guide rails 35 and 34, respectively the angle of deflection is increased.

As carton C continues to be shuttled through first preformer 91*a*, its leading edge enters the zone of electric eyes 141*a* and 142*a*. As the carton's leading edge interrupts the light beam of first electric eye 141*a*, nothing occurs. However as the light beam of the second electric eye 142*a* is interrupted, an activation signal is sent to glue applicator 93*a*. Thus in the present invention, only when both electric eye light beams are interrupted will a signal be supplied to activate the glue applicator 93*a*. If both light beams are not interrupted, the applicator 93*a* does not functions.

As applicator 93*a* is actuated, sprayer 125 shoots standard hot glue from nozzles 132*a* to 135*a* into the carton. As seen in FIG. 7, in the preferred embodiment, the nozzles are focused to establish glue lines at different heights on carton end walls C5 and C6. Nozzles 132*a* and 133*a* are arranged to establish glue lines above and below the handle hole of wall C6 and nozzles 134*a* and 135*a* focused to establish similar glue lines at wall C5 as the carton C is shuttled past applicator 93*a*. Further, the plane of focus of nozzles 132*a* to 135*a* is arranged to be equidistant between the electric eye light beams in the direction of travel of the carton (i.e. the major axial direction of platform 20). Accordingly, glue will first be applied at the interiors of the respective end walls at a distance along the width of the end wall, as measured from the leading edge of the carton, which is equal to the distance from the plane of focus of the spray nozzles to the light beam of second electric eye 142*a*. This is so by virtue of the fact that the glue applicator will be activated only when both electric eye light beams are interrupted.

Glue will be applied in the manner described until the trailing edge of the carton C passes out of first electric eye 141*a*'s light beam. At this point, the light beam of electric eye 141*a* will again be uninterrupted and the glue applicator will be shut off.

For the reasons stated with respect to the point of first glue application, glue will not be applied at the interior of the respective end walls for a distance along the width of the end wall, measured from the trailing edge of the carton, which is equal to the distance from the plane of focus of the spray nozzles to the first light beam of eye 141*a*.

Therefore, the glue line length in the carton is equal to the length of the carton minus the distance between the light beams. Further the glue line length will be centered with respect to the carton's width when the plane of focus of the nozzles is located equidistant between the light beams of the electric eyes as measured in the direction of movement of the carton, i.e. platform 20's major axial direction.

It is to be understood that other arrangements of the spray nozzles may be employed to obtain different glue patterns. However it is a feature of this invention to employ a glue applicator which uses two light beams spaced in the direction of movement of the carton, both of which must be interrupted to activate the glue applicator to obtain a glue pattern whose length is automatically determined by the distance between the leading edge and the trailing edge of the carton and the distance between the light beams to be interrupted.

Again with reference to FIGS. 5 and 7, as glue is sprayed into carton C, second set of preformes 92 are engaged. As the leading edge of the carton engages plate 110*a* and 111*a* of the second preformer, the fingers at the leading edges, i.e. 119*a* engage the carton flaps. As the flaps are engaged, they are further preformed to a second preform angle. The second preform angle is substantially equal to 90 degrees as measured from the vertical. In the preferred embodiment, the angle of incline of finger 119*a* is 30 degrees as measured from the horizontal. The second angle of preform can best be seen in FIG. 9. As carton C continues to be shuttled into second preformer 92*a*, the carton end walls, at the preformed flaps' bend points are trained under the lips of the respective plates 110*a*, 111*a* (i.e. example 115*a*) thereby restraining the carton against vertical movement.

At this point, the carton enters the zone of a second sensor S2*a*. In the preferred embodiment sensor S2*a* is a pressure sensitive electrical switch located in platform 20 as seen in FIG. 7. On reaching sensor S2*a*, an appropriate signal is sent to the apparatus. When sensor S2*a* informs the system of the arrival of carton C, a signal is sent to shuttle 33 to initiate reciprocation thereof for shuttling a carton admitted at entrance 76 to the alternate wall reinforcement former 90*b*. In the preferred embodiment, shuttle 33 however will not be permitted to reciprocate unless sensor S1 has indicated the admission of a carton. If a carton has been admitted, the admitted carton will be shuttled to wall reinforcement former 90*b*.

With the apparatus of this invention, it would also be possible to further qualify reciprocation of shuttle 33. For example, reciprocation may be further qualified by whether the flap folder at wall reinforcement former 96*b* has completed its operation or vice versa.

As sensor S2*a* provides an indication to the apparatus of carton C's presence at flap folder 94*a*, in addition to shuttle 33 being activated, flap folder 94*a* is activated.

As seen in FIG. 8, when actuator 161*a* of flap folder 94*a* is activated, carriage 160*a* is driven downwardly toward the preformed flaps of carton C by actuator piston 173*a*. As the carriage approaches the carton top, alignment skids 190*a*, 191*a*, engage and position the carton under the carriage and rollers.

As the carton is aligned under carriage 160*a*, rollers 182*a* to 185*a* engage the preformed flaps and plow them into the carton. As the flaps are plowed into the carton, the flaps and end walls are braced by lateral guide rails 34 and 35 which form anvils 163*a*. Accordingly, the respective flaps, end walls and glue are compressed between the rollers and the anvils. This may best be seen in FIG. 11. During the compression process, as the flaps are plowed into the carton, the glue previously applied is spread over the respective flap and end wall interfaces.

In the preferred embodiment, the respective flaps and end walls are compressed approximately 25% to form a durable reinforced wall.

As actuator 161*a* reaches the bottom of its stroke, a signal is provided to withdraw the rollers 182*a* to 185*a* from the carton. The means used to accomplish this in the preferred embodiment is trip 210*a* located on the upper end of piston guide rail 174*a* and switch S3*a* on frame beam 10*a* as seen in FIG. 8.

Further to aid withdrawal of the rollers from the carton, removal skids 196*a* and 197*a* are provided on opposite ends of the carriage.

Finally in the preferred embodiment, to prevent the carton C from riding up with the rollers as they are removed, the lips at the upper edge of plates 110*a* and 111*a* (e.g. 115*a*) hold the carton in place.

Following removal of the rollers, the carton is ready to be ejected at the apparatus exit by a subsequent carton shuttled to the flap folder in the manner previously described.

As noted above, the present apparatus utilizes a system of pneumatic actuators and an electrical sequencer.

The system sequencer includes a plurality of carton sensors, a plurality of activators and a controlled unit.

The carton sensors determine the presence or absence of cartons at various locations within the system and communicate that information to the controller. In the preferred embodiment, the sensors are pressure sensitive electrical switches which respond to the physical presence or absence of a carton.

The activators are located in association with the pneumatic actuators of the various system elements, for example, the flap folders, the shuttle and the carton vertical guide. The activators are electrically connected to the sequencer controller, and activate the pneumatic actuators on receipt of appropriate signals from the controller. In the preferred embodiment, the activators are a plurality of solenoidal relays.

The controller of the sequencer includes a plurality of electrical circuits which are connected to both the sequencer sensors and the sequencer activators. The controller supplies signals of appropriate sequence of the various activators on receipt of correspondingly appropriate signals from the various sensors.

The pneumatic actuators of the present system are connected to a supply of air and as noted above to the sequencer. As note above, the actuators are activated by the activators on receipt of appropriate signals from the sequencer controller.

Figure 12:
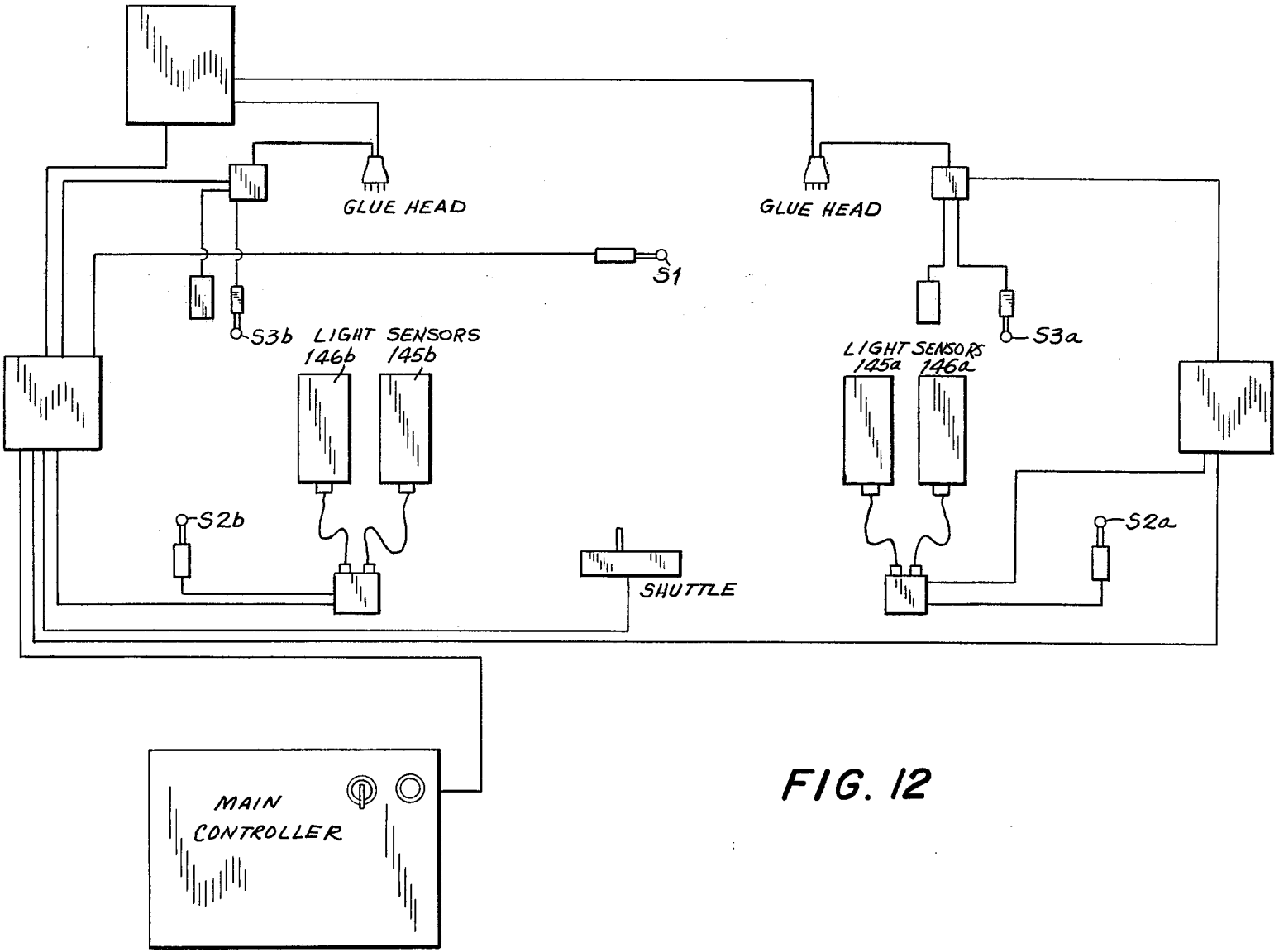
FIG. 12 is a view of the sequencer of this invention in block representation.
Figure 13:
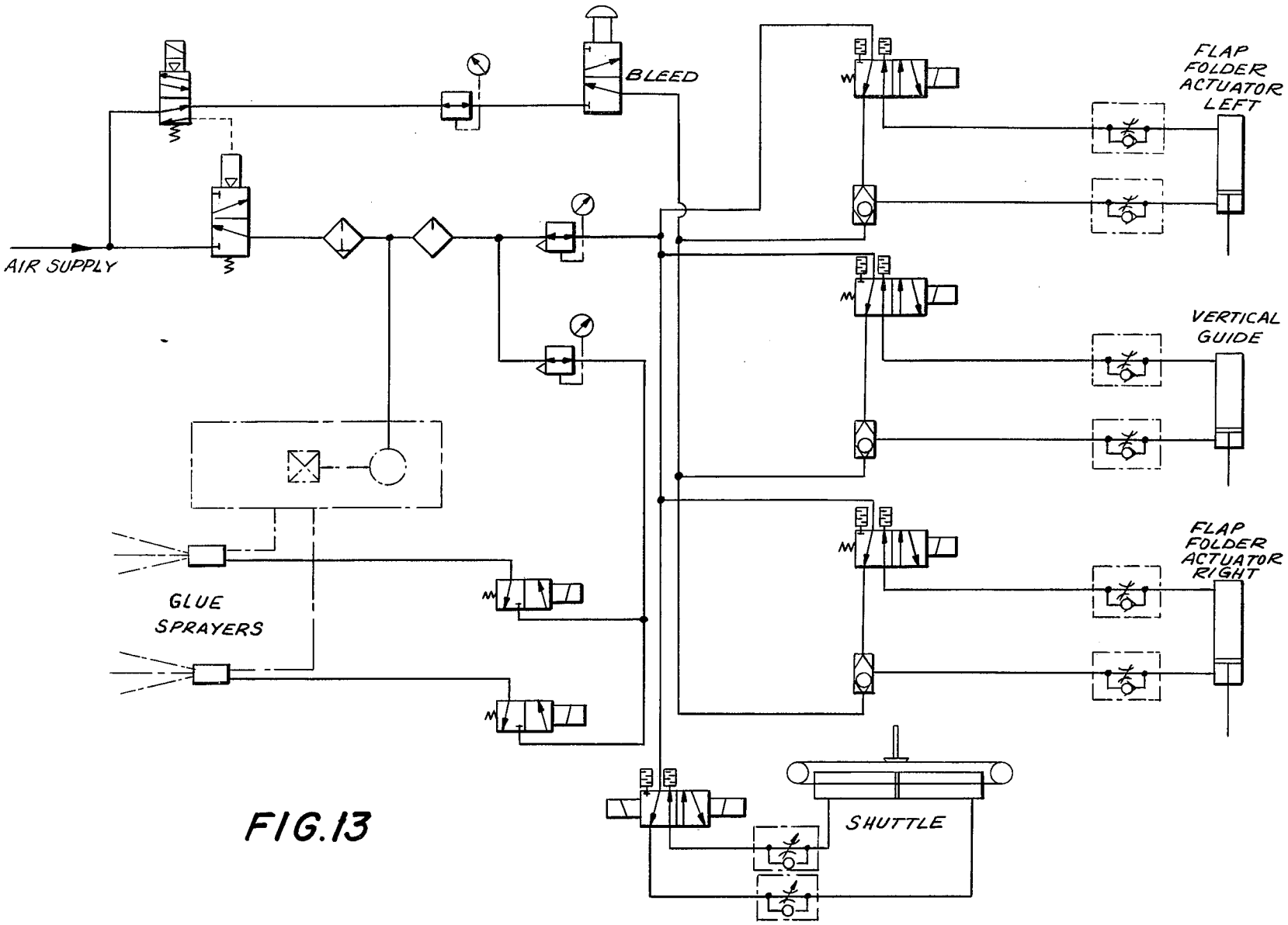
FIG. 13 is a schematic view of the pneumatic actuating system of this invention.

Both the elements of the electrical sequencer and the pneumatic actuator system are standard and readily available. Accordingly, their particular elements do not form a part of this invention and will not be described in detail. However, FIGS. 12 and 13 have been provided to describe in general form the character of the electrical sequencer and the pneumatic actuator system.

The invention and many of its attendant advantages will be understood from the foregoing description. It will be apparent to those skilled in the art that various changes may be made in the form, construction and arrangement of the parts without departing from the spirit of scope of the invention. The description previously set forth is merely a description of a preferred embodiment of the invention.

What is claimed is:

1. Apparatus for forming wall reinforcements in multiple individual cartons, each carton having end walls substantially perpendicular to the carton's length axis, side walls substantially perpendicular to the carton's width axis and flaps integrally formed with some or all carton walls, certain of which flaps extend substantially vertically above the carton top in the plane of their respective walls, the apparatus comprising:

a frame for supporting the apparatus;

a bed supported by the frame;

a receiver in association with the bed for sequentially receiving and admitting cartons in a controllable manner;

two wall reinforcement formers, each having a plurality of work stations with means that are located in association with the bed and the frame for forming vertical carton flaps into reinforcing relationship with respective carton walls;

a distributor in association with the bed, receiver, and wall reinforcement formers for engaging successive cartons from the receiver and alternately distributing them along the bed to the wall reinforcement formers;

means defining exits in association with the bed and reinforcement formers enabling discharge of cartons after formation of wall reinforcements; and a sequencer in communication with the receiver, distributor and wall reinforcement formers for coordinating and sequencing movement of and work on the cartons, enabling formation of wall reinforcements in multiple individual boxes.

2. Apparatus as described in claim 1 wherein the bed is a platform over which the cartons may be moved, the platform having a major and minor axis, with sides substantially perpendicular to the platform's minor axis and ends substantially perpendicular to the platform's major axis, one wall reinforcement former being located at each platform end and the receiver being located between the wall reinforcement formers.

3. Apparatus as described in claim 2 wherein the distributor is arranged to operate in the platform's major axis between the wall reinforcement formers.

4. The apparatus of claim 3 wherein the means defining exits are located at the opposite platform ends in association with the respective wall reinforcement formers.

5. The apparatus of claim 4 wherein the distributor comprises:

lateral carton guides located at the perimeter of both platform sides extending in the platform's major axial direction, for restraining the cartons against movement in the platform's minor axial direction;

a vertical carton guide, mounted above the platform, between the wall reinforcement formers, for restraining vertical carton movement; and a shuttle for moving the cartons in the platform's major axial direction through the wall reinforcement former located at one platform end or the other.

6. The apparatus of claim 5 wherein the receiver comprises:

an entrance formed as a single opening in the lateral carton guides on one platform side.

7. The apparatus of claim 6 where the receiver further includes:

a gate formed by the vertical carton guide, which is movable from a first open position out of the path of the cartons, permitting carton movement through the entrance, to a second closed position where the vertical restraint may restrain vertical movement of the carton admitted and prohibit entrance of a subsequent carton.

8. The apparatus of claim 6 wherein the sequencer comprises:

a plurality of sensors arranged at predetermined locations within the apparatus for sensing the presence or absence of a carton at the predetermined location;

a plurality of activators in signal communication with predetermined elements of the apparatus for activating the predetermined elements; and a signal controller in signal communcation with the sensors and the activators for communicating signals to the various activators in a predetermined sequence responsive to the signals received from the sensors.

9. Apparatus as described in claim 8 wherein the wall reinforcement formers comprise:

carton vertical flap preformers for deflecting the vertical flaps inboard of the carton and out of the vertical plane of the respective carton wall;

a glue applicator for establishing a predetermined glue pattern on the interior of the carton walls having vertical flaps; and a vertical flap folder for folding the preformed vertical flaps inboard of the carton and into reinforcing relation with the respective carton walls.

10. The apparatus of claim 5 wherein the shuttle comprises:

a cable and pulleys located for movement lengthwise in the platform's major axis;

a carton engager mechanically connected to the cable for engaging a carton admitted to the apparatus platform; and a cable actuator for reciprocally driving the cable in the platform's major axial direction so that cartons may be moved to one end of the platform or the other alternately.

11. The apparatus of claim 8 wherein the sequencer includes a plurality of electrical circuits.

12. The apparatus of claim 11 wherein the signal controller includes the plurality of electrical circuits, the electrical circuits being electrically connected to both the sensors, which are pressure sensitive switches that make and break the electrical circuits and the activators, which are a plurality of solenoidal relays for initiating operaion of predetermined apparatus elements.

13. The apparatus of claim 9 wherein the cartons have vertical flaps only at the end walls and are admitted into the apparatus through the receiver with their ends in a plane parallel to the plane of the platform sides, the vertical flap preformers comprising:

a first preformer, for engaging carton flaps as cartons are moved past the preformer by the shuttle means, causing the flaps to be deflected inboard of the cartons and out of the vertical plane of the respective carton end walls to a first preforming angle less than 90 degrees measured from the vertical and a second preformer for engaging the vertical flaps which have been preformed to the first preform angle and further preforming the flap to a second preform angle substantially equal to 90 degrees measured from the vertical.

14. The apparatus of claim 13 wherein the first preformer includes a pair of bars, one of which is mounted on each side of the platform, the bars extending in part over the platform, each bar extending from inboard its respective platform side, to outboard of its respective platform side, being inboard at the region over the platform closest to the respective platform end and outboard at the region farthest from the respective platform end, so that vertical carton flaps are urged out of the vertical as cartons engage and are pushed through the first preformer by the shuttle.

15. The apparatus of claim 14 wherein the lateral carton guides are generally rectangular rails adjustably arranged in planes parallel to the platform sides, the rails having upper edges, and wherein the second performer is a pair of plates one of which is mounted at each platform side on the respective lateral carton guide to form a lip above and parallel to the respective lateral carton guide's upper edge, each lip having a leading edge formed as a finger vertically inclined from the respective lip and oriented to engage the respective vertical carton flap at the first preform angle and cause the flap to be guided and preformed to a second preform angle substantially equal to 90 degrees as measured from the vertical as the carton is moved under the lip and through the second preformer by the shuttle.

16. The apparatus of claim 9 wherein the glue applicator comprises:

a controllable glue sprayer having a plurality of spray nozzles and glue supply conduits in fluid communication with the nozzles, the nozzles being focused to establish a predetermined glue pattern on the inside of the carton walls to be reinforced when the sprayer is activated and the carton is moved past the nozzles;

control means for activating the glue sprayer in response to movement of the carton so that the glue pattern is predetermined by the control means, glue sprayer and the carton itself.

17. The apparatus of claim 16 wherein the control means comprises:

two light sets, each set including a light source and companion light sensor, each set disposed adjacent to the platform's sides, the light source and light sensor of each set being located on opposite sides of the platform to establish two light beams transverse of the platform, the sets being spaced a predetermined distance in the platform's major axial direction such that the light beams are spaced a predetermined distance in the platform's major axial direction;

an electrical circuit in communication with the light sets and glue sprayer to activate the sprayer when both light beams are interrupted by the carton and to deactivate the sprayer when one or both beams is uninterrupted, the glue pattern sprayed on the interior carton walls to be reinforced being automatically determined by the spacing of the light beams in the platform's major axial direction, the focus of the spray nozzles and the dimensions of the carton.

18. The apparatus of claim 9 wherein the carton has vertical flaps only at the end walls and is admitted to the platform by the receiver with the carton end walls parallel to the plane of the platform's sides, the vertical flap folder comprising:

a carriage;

an actuator mounted on the frame above the platform, being mechanically coupled to the carriage for movement of the carriage in the vertical direction on receipt of a signal from the sequencer;

rollers rigidly mounted to the carriage for engaging the preformed vertical flaps of the carton to drive the flaps into the carton and up against the carton end walls as the actuator moves the carriage in the vertical direction;

anvils located at the platform sides for bracing the carton end walls as the rollers fold the flaps into the carton causing the flaps and end walls to be compressed together.

19. The apparatus of claim 18 wherein:

the carriage has an upper surface, a lower surface, sides substantially perpendicular to the carriage width axis and ends substantially perpendicular to the carriage length axis;

the actuator including a cylinder, and piston received in the cylinder;

the actuator piston being coupled to the upper surface of the carriage;

the rollers being rigidly fixed to the ends of the carriage; and the actuator being mounted to the frame so that the carriage and rollers may be moved in the vertical direction from a first vertical position, displaced above the platform, to a second vertical position more proximate the platform than the first position, and returned to the first vertical position.

20. The apparatus of claim 19 further including aligners mounted on the carriage for engaging the carton and positioning it beneath the carriage as the carrier is moved in the vertical direction towards the second vertical position.

21. The apparatus of claim 20 further including a carton retainer for holding the carton as the rollers are withdrawn following compression of the flaps and end walls so that the carton is restrained from vertical movement as the rollers are withdrawn.

22. The apparatus of claim 21 wherein the retainers are the lips of the second preformer.

23. The apparatus of claim 22 wherein the anvils are the lateral carton guides in the region of the vertical flap folder.

24. The apparatus of claim 5 wherein the shuttle comprises:

a cable and pulleys located for movement lengthwise in the platform's major axial direction;

a carton engager mechanically connected to the cable for engaging a carton admitted to the apparatus platform;

a cable actuator for reciprocally driving the cable in the platform's major axial direction so that cartons may moved to one end of the platform or the other alternately.

25. Apparatus for forming wall reinforcements in multiple individual cartons, each carton having end walls substantially perpendicular to the carton's length axis, side walls substantially perpendicular to the carton's width axis and vertical flaps integrally formed with the the end walls, the flaps extending substantially vertically above the carton top in the plane of the respective end walls, the apparatus comprising:

a frame for supporting the apparatus;

a platform over which the cartons may be moved, the platform having a major and minor axis with the ends substantially perpendicular to the platform's major axis and sides substantially perpendicular to the platform's minor axis;

a receiver in association with the platform for sequentially receiving and admitting cartons to the platform in a controlled manner; the receiver including a single entrance;

two wall reinforcement formers, one wall reinforcement former being located in association with each of the platform end regions, with the receiver entrance located approximately midway between the wall reinforcement formers, the wall reinforcement formers including preformers for deflecting the vertical flaps inboard of the carton and out of the vertical plane of the respective carton end walls, a glue applicator for establishing a predetermined glue pattern at the interior of the carton end walls and a vertical flap folder for folding the vertical flaps inboard of the carton and into reinforcing relation with the respective carton end walls;

a distributor disposed for operation in the platform's major axis between the wall reinforcement formers, the distributor including lateral carton guides located at the perimeter of both platform sides extending in the platform's major axial direction, for restraining cartons against movement in the platform's minor axial direction, a vertical carton guide, mounted above the platform, between the wall reinforcement formers, restraining vertical carton movement, and a shuttle for alternately moving the cartons in the platform's major axial direction through the wall reinforcement formers located at one platform end or the other;

means defining exits located at the opposite platform ends in association with the respective wall reinforcement formers; and a sequencer in signal communication with the receiver, the distributor and wall reinforcement formers, coordinating and sequencing movement of and work on the cartons, the sequencer including a plurality of sensors arranged at a predetermined location within the apparatus for sensing presence or absence of cartons, a plurality of activators in signal communication with the predetermined elements of the apparatus for activating the predetermined elements, and a signal controller in signal communication with the sensors and activators for communicating signals to the various activators in a predetermined sequence responsive to signals received from the sensors, enabling formation of wall reinforcements in multiple individual cartons.

26. The apparatus of claim 25 wherein the signal controller includes the plurality of electrical circuits, the electrical circuits being electrically connected to both the sensors, which are pressure sensitive switches that make and break the electrical circuits and the activators, which are a plurality of solenoidal relays for initiating operation of specific apparatus elements.

27. The apparatus of claim 25 wherein the glue applicator comprises:

a controllable glue sprayer having a plurality of spray nozzles and glue supply conduits in fluid communication with the nozzles, the nozzles being focused to establish a predetermined glue pattern on the inside of the carton walls to be reinforced when the sprayer is activated and the carton is moved past the nozzles;

control means for activating the glue sprayer in response to movement of the carton so that the glue pattern is predetermined by the control means, glue sprayer and the carton itself.

28. The apparatus of claim 27 wherein the control means comprises:

two sets of lights, each set including a light source and companion light sensor, each set disposed adjacent to the platform sides, the light source and light sensor of each set being located on opposite sides of the platform to establish two light beams transverse of the platform, the sets being spaced a predetermined distance in the platform's major axial direction, such that the light beams are spaced a predetermined distance in the platform's major axial direction;

an electrical circuit in communication with the light sets and glue sprayer to activate the sprayer when both light beams are interrupted by the carton and to deactivate the sprayer when one or both beams is uninterrupted, the glue pattern sprayed on the interior carton walls to be reinforced being automatically determined by the spacing of the light beams in the platform's major axial direction, the focus of the spray nozzles and the dimensions of the carton.

29. The apparatus of claim 24 wherein the vertical flap folder comprising:

a carriage;

an actuator mounted on the frame above the platform, being mechanically coupled to the carriage for movement of the carriage in the vertical direction on receipt of a signal from the sequencer;

rollers rigidly mounted to the carriage for engaging the preformed vertical flaps of the carton to drive the flaps into the carton and up against the carton end walls and the actuator moves the carriage in the vertical direction;

anvils located at the platform sides for bracing the carton end walls as the rollers fold the flaps into the carton causing the flaps and end walls to be compressed together.

30. The apparatus of claim 29 wherein:

the carriage has an upper surface, a lower surface, sides substantially perpendicular to the carriage width axis and ends substantially perpendicular to the carriage length axis;

the actuator including a cylinder, and piston received in the cylinder, and piston guide bars;

the actuator piston being coupled to the upper surface of the carriage, the rollers being ridigly fixed to the ends of the carriage; and the actuator being mounted to the frame so that the carriage and rollers may be moved in the vertical direction from a first vertical position, displaced above the platform, to a second vertical position more proximate the platform than the first position, and returned to the first vertical position.

* * * * *

UNITED STATES PATENT AND TRADEMARK OFFICE

CERTIFICATE OF CORRECTION

PATENT NO. : 4,261,254

DATED : April 14, 1981

INVENTOR(S) : Ulrich G. Nowacki

It is certified that error appears in the above—identified patent and that said Letters Patent is hereby corrected as shown below:

Col. 11, line 59 - "," should be -- . --;

Col. 11, line 67 - "locaton" should be -- location --;

Col. 12, line 38 - "functions" should be -- function --;

Col. 13, line 23 - "preformes" should be -- preformers --;

Col. 16, line 56 - "operaion" should be -- operation --;

Col. 17, line 20 - "performer" should be -- preformer --;

Col. 18, line 37 - "carrier" should be -- carriage --;

Col. 18, line 59 - "moved" should be -- move --.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*